United States Patent [19]

Stafford et al.

[11] Patent Number: 4,579,171

[45] Date of Patent: Apr. 1, 1986

[54] SHELL AND TUBE HEAT EXCHANGER WITH WELDS JOINING THE TUBES TO TUBE SHEET

[75] Inventors: Donald C. Stafford, Hinsdale; Tushar K. Shah, Cresthill; Vincent F. Allo, Warrenville, all of Ill.

[73] Assignee: Chicago Bridge & Iron Company, Oakbrook, Ill.

[21] Appl. No.: 472,265

[22] Filed: Mar. 4, 1983

[51] Int. Cl.[4] ..... F28D 3/02; F28F 9/18; B21D 53/00; B23K 31/02

[52] U.S. Cl. ..... 165/115; 165/118; 165/173; 29/157.4; 29/727; 228/183; 228/173.2; 228/173.4

[58] Field of Search ..... 165/118, 115, 173, 175; 29/157.4, 727; 228/173.2, 173.4, 175, 183

[56] References Cited

U.S. PATENT DOCUMENTS

| | | | |
|---|---|---|---|
| 1,589,646 | 6/1926 | Hicks | 165/173 |
| 2,069,430 | 2/1937 | Voss | 165/118 |
| 2,178,095 | 10/1939 | Bowser | 165/175 |
| 2,519,845 | 8/1950 | Mojonnier et al. | 165/118 |
| 2,785,459 | 3/1957 | Carpenter | 165/173 |
| 3,317,222 | 5/1967 | Maretzo | 29/157.4 |
| 3,465,727 | 9/1969 | Tidball | 29/157.4 |
| 3,979,810 | 9/1976 | Krips et al. | 29/157.4 |
| 4,071,083 | 1/1978 | Droin | 165/173 |
| 4,142,581 | 3/1979 | Yoshitomi et al. | 165/173 |
| 4,182,408 | 1/1980 | Laber | 165/173 |
| 4,199,537 | 4/1980 | Zardi et al. | 165/118 |
| 4,286,436 | 9/1981 | Engdahl | 165/173 |
| 4,420,867 | 12/1983 | Busse | 29/157.4 |

FOREIGN PATENT DOCUMENTS

| | | | |
|---|---|---|---|
| 662537 | 6/1938 | Fed. Rep. of Germany | 165/115 |
| 0020687 | 6/1973 | Japan | 228/183 |
| 0022154 | 2/1977 | Japan | 29/157.4 |
| 294432 | 4/1965 | Netherlands | 165/115 |

*Primary Examiner*—William R. Cline
*Assistant Examiner*—John K. Ford
*Attorney, Agent, or Firm*—Marshall, O'Toole, Gerstein, Murray & Bicknell

[57] ABSTRACT

A falling film heat exchanger in which a continuous weld circumferentially joins each tube to the outer surface of the upper, and desirably also the lower, tubesheet. The welds seal the crevices between the tubes and tubesheet holes and prevent corrosion. Since the circumferential welds cannot be deposited if the tube ends extend more than about 2 inches past the tubesheet, extensions can be added by welding.

1 Claim, 4 Drawing Figures

SHELL AND TUBE HEAT EXCHANGER WITH WELDS JOINING THE TUBES TO TUBE SHEET

This invention relates to shell and tube falling film heat exchangers. More particularly, this invention is concerned with an improved heat exchanger which has the tubes welded to at least the upper tubesheet top surface to prevent crevice corrosion between the tube wall and the tubesheet.

BACKGROUND OF THE INVENTION

Shell and tube heat exchangers have an array of tubes extending between and through two spaced apart tube sheets surrounded by a shell. The shell is provided with an inlet and an outlet so that a suitable heat exchange liquid or gas can be circulated through the shell to cool or heat a liquid flowing through each tube.

Each end of the array of tubes can be left open, or exposed, for use in some processing operations. For other operations, one or both ends can be enclosed by a liquid retaining header, which may or may not have a removable cover or access port. When only one liquid header is present, it can be either a liquid inlet or liquid outlet. When a liquid header is positioned at each end, one liquid header can constitute a liquid inlet while the other can be a liquid outlet. Such an arrangement is conventional for once-through or single pass heat exchangers. The liquid inlet and outlet headers, or portions thereof, are provided with suitable conduit means for supplying and removing liquid.

Although shell and tube heat exchangers are generally used to heat a liquid feed stream, they can be used for cooling such a stream. Shell and tube heat exchangers of the described types can be used as freeze exchangers for producing fresh water from brackish water and seawater, for concentrating fruit and vegetable juices, and in industrial crystallization processes. As the liquid flows through each tube, it can be cooled enough to crystallize a solid from the liquid. Thus, by cooling seawater, ice is obtained which when separated, washed and melted provides potable water. When a fruit or vegetable juice is similarly chilled, ice forms and is removed to provide a concentrated juice.

Heat exchangers of the described types can use any cooling fluid on the shell side to cool a liquid flowing through the tubes. The fluid can be fed through one end and removed through the other end of the heat exchanger in a substantially unidirectional flow. Some suitable cooling fluids are ammonia and Freon brand refrigerants.

To obtain optimum heat exchange it is desirable in many instances for the tubes to be arranged vertically and for the feed liquid to be supplied to the tube surfaces as a downwardly flowing or falling liquid film. Not only is the feed liquid brought more quickly close to the temperature of the heat exchange liquid in this way but less recirculation of the liquids is required, thus reducing energy consumption.

It is customary to locate heat exchange tubes close together and parallel to one another and often with a tube pitch of 1.25 times the tube diameter. Tube pitch is the distance between the center of two adjacent tubes in any direction. One of the most efficient ways to seal the tubes to the tubesheets is to roll expand the tube against the wall of the hole in the tubesheet through which the tube extends. In this way a liquid tight seal is readily and inexpensively produced. Formation of joints by roll expansion, however, usually have a crevice or gap in the space between the tube wall and the surfaces of the tubesheets. This crevice may extend inwardly from the tubesheet surface about 0.25 to 1 inch depending somewhat on the thickness of the tubesheet and the roll forming technique.

In many cases the existence of the crevices creates no problem. However, when some liquids, such as those which are corrosive, are treated in a heat exchanger the crevices have been found to be a prime location of corrosion, even when stainless steel is used for the tubes and tubesheets. Such corrosion is not restricted to elevated temperatures but also occurs in freeze exchangers as, for example, when fresh water is produced from salt water and brackish water by production of ice and subsequent melting of the ice. Furthermore, when the tubes are simply rolled into a tubesheet it is very likely that a leak may develop at those joints thus leaking the refrigerant into the water box. This can occur even if the liquid flowing through the tubes is not corrosive.

Not only is it desirable to provide some means to eliminate crevice corrosion and leaks but the solution to those problems should permit fabrication of a heat exchanger with the upper ends of the tubes extending above the top surface of the upper tubesheet. This permits the feed liquid to flow around the tubes and form a pool before it spills over the lip of the tubes as a falling film, thereby achieving a more even distribution of liquid to the tubes.

SUMMARY OF THE INVENTION

According to one aspect of the invention, there is provided a falling film heat exchanger comprising a shell connected to vertically spaced apart horizontally arranged upper and lower tubesheets; a plurality of tubes vertically positioned and parallel to one another extending through holes in the tubesheets in fluid-tight sealing engagement therewith achieved by roll expansion of the tubes against the walls of the holes; and a continuous weld circumferentially joining each tube to the top of at least the upper tubesheet.

Although the tops of the tubes can be flush with the top surface of the upper tubesheet, the invention is more suitably used when the tops of the tubes extend uniformly above the top surface of the upper tubesheet. However, when the tubes are close together, the tops of the tubes will generally be less than two inches above the tubesheet, unless the tubes are subsequently extended, because it is not feasible at present to manually or machine deposit the circumferential welds when the tubes are taller and close together because there is insufficient working room in which to weld.

According to a second aspect of the invention there is provided a falling film heat exchanger comprising a shell connected to vertically spaced apart horizontally arranged upper and lower tubesheets; a plurality of primary tubes vertically positioned close together and parallel to one another extending through holes in the tubesheets in fluid-tight sealing engagement therewith; the upper ends of the tubes projecting above the top surface of the upper tubesheet a short distance no greater than that which permits circumferential welding of the tube wall to the tubesheet by a fillet weld; a continuous fillet weld circumferentially joining each tube wall to the top of the upper tubesheet; and an extension tube axially positioned on, and welded to, the top ends of the primary tubes.

The top of the primary tubes will usually be less than two inches above the top surface of the upper tubesheet.

In general, the extension tubes will be at least four inches long, although in many cases a minimum of six inches or more is desirable.

Even though not essential to this aspect of the invention, it is especially useful when the primary tubes are sealed in the tubesheet holes by roll expansion before the circumferential welds are deposited joining the primary tubes to the tubesheet.

DETAILED DESCRIPTION OF THE DRAWINGS

To the extent it is reasonable and practical and facilitates clarity, the same or similar elements or parts which appear in the various views of the drawings will be identified by the same numbers.

Figure 1:
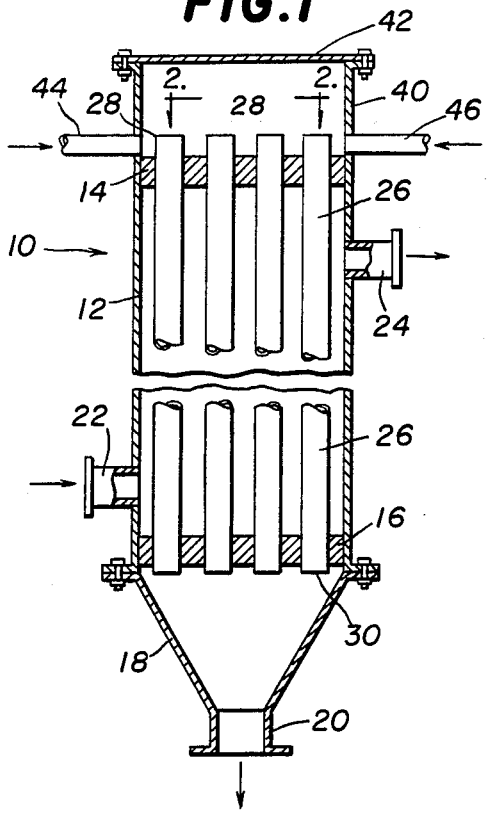
FIG. 1 is an elevational view, partially in section, of a heat exchanger according to the invention.

The heat exchanger 10 shown in FIG. 1 has a vertical cylindrical circular shell 12 joined to upper tubesheet 14 and lower tubesheet 16. A frustoconical transition shell 18, constituting a lower header, is connected to the bottom of shell 12 and provided with an outlet 20 for feeding liquid from the heat exchanger to a suitable collecting tank or conduit. A heat exchange fluid can be fed to the shell side of the heat exchanger through inlet 22 and it can be withdrawn through outlet 24. When the heat exchanger is used as a freeze exchanger, a refrigerant such as ammonia can be used as a cooling fluid.

Figure 2:
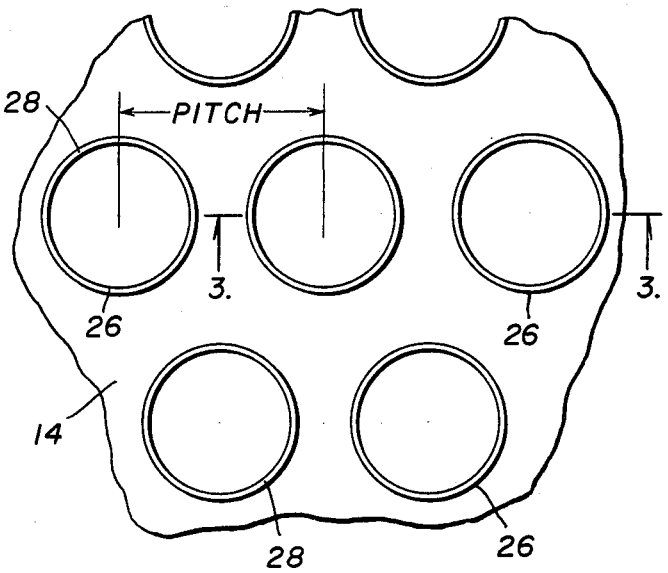
FIG. 2 is a partial plan view taken along the line 2—2 of FIG. 1.

A plurality of primary heat exchange tubes 26 extend through holes in the upper and lower tubesheets 14 and 16. As shown in FIG. 2, the tubes 26 are placed close together. The tops 28 of the tubes 26 extend or project above the top surface of upper tubesheet 14. Similarly the lower ends 30 of the tubes extend past the bottom surface of lower tubesheet 16.

Figure 3:
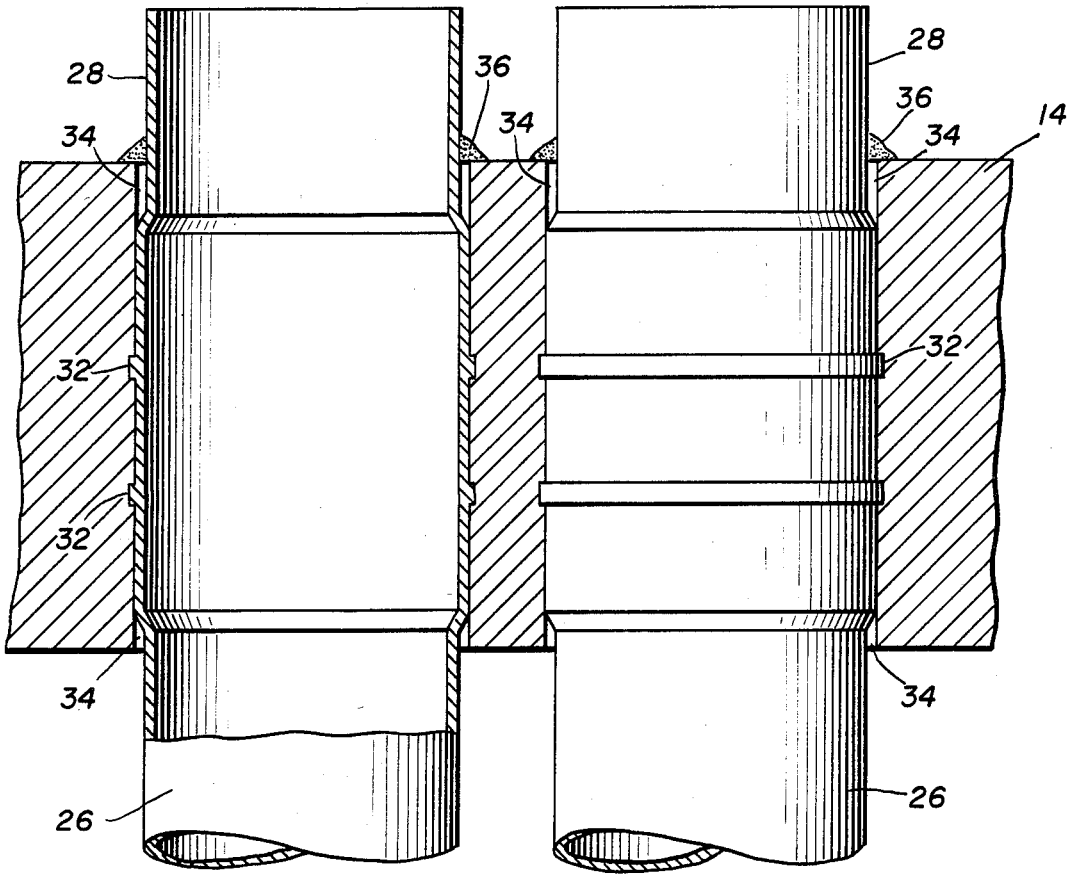
FIG. 3 is a view, partially in section, taken along the line 3—3 of FIG. 2.

Each of the tubes 26 is roll expanded against the wall of the hole through which it passes, as shown in FIG. 3. The tubesheet holes contain shallow circular grooves 32 into which the metal of the tube walls flows thereby further facilitating formation of a fluid tight seal and a joint which restricts axial displacement of the tubes relative to the tubesheets.

Roll expansion of the tubes as described generally results in a circular crevice 34 between the tube wall and the wall of the holes in the tubesheet at both surfaces of each tubesheet. Corrosion in the crevices on the shell side is much less of a problem since non-corrosive heat exchange fluids are available. The crevices are areas of high potential corrosion on the tube side of the heat exchanger when corrosive liquids are processed. To prevent crevice corrosion on the tube side, a circumferential fillet weld 36 is placed over the open end of the crevice so as to join the tube wall and the adjacent tubesheet outer surface (FIG. 3). Although not illustrated, a similar weld can be placed over the crevices on the bottom surface of the lower tubesheet.

When the tubes 26 are placed close together, the tops 28 of the tubes 26 cannot extend very far above the top surface of the tubesheet 26 because if they do there will be inadequate working room for welding, whether done manually or automatically. It is therefore necessary to correlate the tube projection height and distance between tubes so as to provide clearances needed for welding. This also applies if the tube lower ends project out of the lower tubesheet.

It should be understood that while the welds 36 inherently provide structural integrity they are employed primarily to seal off the crevice so as to prevent crevice corrosion and to prevent leaks.

As shown in FIG. 1, the shell 12 has an extension 40 which projects upwardly substantially above the tops 28 of the tubes 26, defining an inlet header. Removable cover 42 spans the extension 40. Two or more radially opposing, or tangentially oriented, inlet conduits 44 and 46 penetrate extension 40 and serve to deliver feed liquid to the header. The liquid flows around the tops 28 of the tubes on the upper surface of tubesheet 14 before it flows into the tubes as a thin film.

Figure 4:
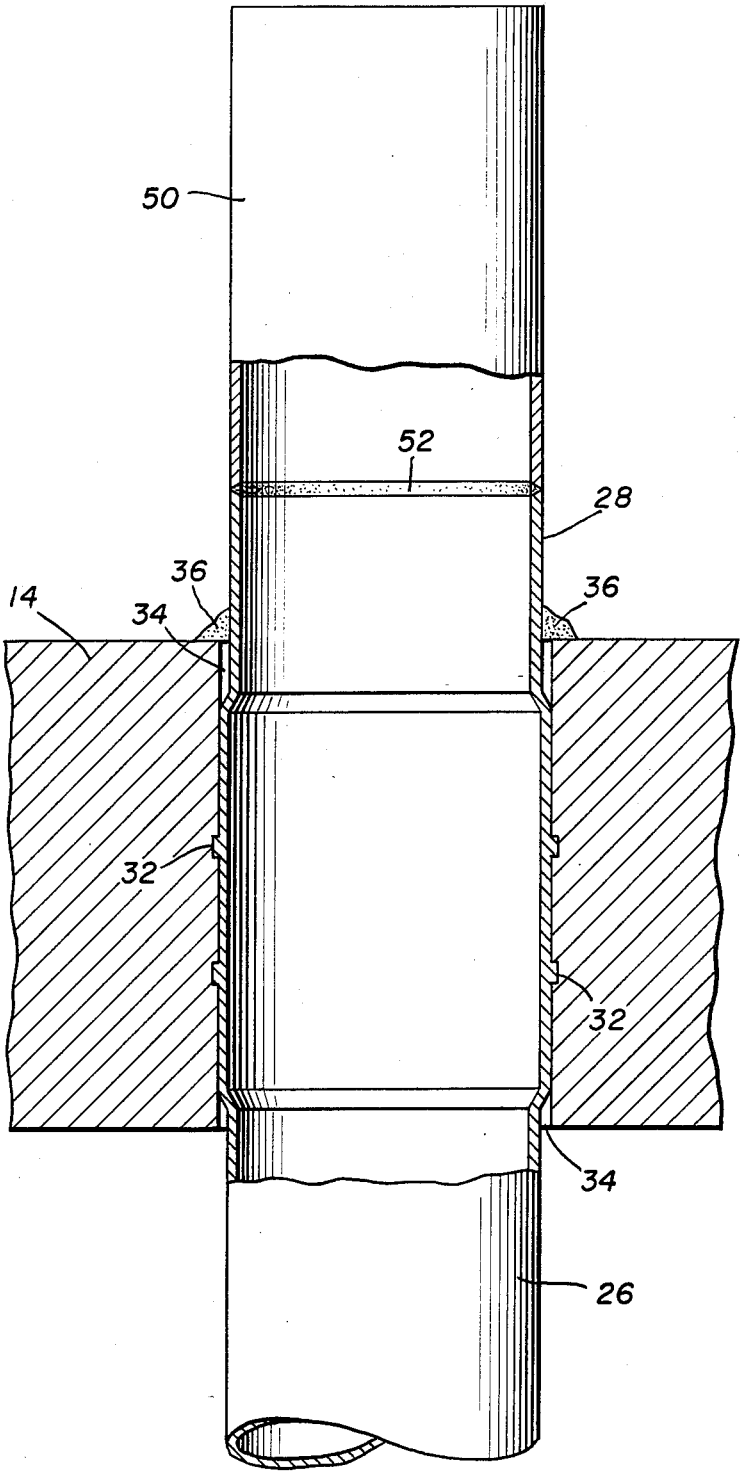
FIG. 4 is an elevational view, partially in section, illustrating a primary tube circumferentially welded to a tubesheet and with an extension tube axially positioned on and welded to the top end of the primary tube.

At times the tube tops 28 may not extend high enough above the surface of tubesheet 14 to obtain even flow of the liquid and development of a pool of uniform height so that feed to each tube is about the same as to all the other tubes. To provide a deeper pool requires that the tube tops 28 be extended upwardly. However, connecting an extension tube 50 axially positioned on the top of the primary tube requires welding the ends together. For this purpose an internal butt weld 52 (FIG. 4) is desirably used when there is not enough room for external welding when the tubes are close together and the extension tube is more than about two inches long.

The foregoing detailed description has been given for clearness of understanding only, and no unnecessary limitations should be understood therefrom, as modifications will be obvious to those skilled in the art.

What is claimed is:

1. A falling film heat exchanger comprising:

a shell connected to vertically spaced apart horizontally arranged upper and lower tubesheets;

a plurality of primary tubes vertically positioned close together and parallel to one another extending through holes in the tubesheets in fluid-tight sealing engagement therewith;

the upper ends of the primary tubes projecting above the top surface of the upper tubesheet a short height;

the distance or pitch between adjoining primary tubes, and the height of the primary tubes above the top of the upper tubesheet, being correlated to permit circumferential welding of each primary tube wall to the tubesheet by a fillet weld;

the primary tubes being about 2 inches in diameter, the primary tubes extending less than 2 inches above the top of the upper tubesheet, a continuous fillet weld circumferentially joining each primary tube wall to the top of the upper tubesheet;

an extension tube axially positioned on, and welded to, the top end of each primary tube after the primary tube is installed in the tubesheets and after the fillet weld is deposited, the extension tubes being more than 4 inches long; and the pitch of the primary tubes is about 1.25 times the primary tube diameter and is such that the extended height of each primary tube above the top of the upper tubesheet, after the extension tube is joined to it, is greater than permits deposit of the fillet weld to the tubesheet.

* * * * *